United States Patent [19]

Wotherspoon

[11] 4,040,211

[45] Aug. 9, 1977

[54] MULTI PORTION TILE HAVING A CURLED INTERLOCK

[75] Inventor: John G. Wotherspoon, Anaheim, Calif.

[73] Assignee: Martin E. Gerry, Santa Ana, Calif. ; a part interest

[21] Appl. No.: 679,491

[22] Filed: Apr. 22, 1976

Related U.S. Application Data

[63] Continuation-in-part of Ser. No. 626,332, Oct. 28, 1975, abandoned.

[30] Foreign Application Priority Data

Mar. 10, 1975 Australia ..... 0843/75

[51] Int. Cl.[2] ..... E04D 1/06; E04D 1/08

[52] U.S. Cl. ..... 52/100; 52/520; 52/541; 52/549; 52/555

[58] Field of Search ..... 52/519, 543, 520, 545, 52/521, 547, 522, 552, 527, 553, 542, 554, 541, 549, 530, 529, 555, 98, 100

[56] References Cited

U.S. PATENT DOCUMENTS

| | | | |
|---|---|---|---|
| 471,450 | 3/1892 | White | 52/522 |
| 487,372 | 12/1892 | Montross | 52/529 |
| 550,325 | 11/1895 | Kinnear | 52/521 X |
| 588,161 | 8/1897 | Montross | 52/529 |
| 640,511 | 1/1900 | White | 52/520 X |
| 749,182 | 1/1904 | Grath | 52/553 X |
| 787,474 | 4/1905 | Sharp | 52/538 |
| 892,248 | 6/1908 | Garvin | 52/543 |
| 1,237,687 | 8/1917 | Nottebohm | 52/538 |
| 1,570,516 | 1/1926 | Miller | 52/530 |
| 1,643,445 | 9/1927 | Call | 52/530 |
| 2,178,357 | 10/1939 | Hoess | 52/530 |
| 2,185,669 | 1/1940 | Isenhour | 52/100 |
| 3,226,901 | 1/1966 | Harter | 52/530 X |
| 3,236,932 | 2/1966 | Grigas et al. | 52/543 |
| 3,347,001 | 10/1967 | Cosden | 52/553 X |
| 3,349,534 | 10/1967 | Wotherspoon | 52/520 |
| 3,485,002 | 12/1969 | Baker | 52/555 X |
| 3,559,359 | 2/1971 | Talbert | 52/529 X |

FOREIGN PATENT DOCUMENTS

| | | | |
|---|---|---|---|
| 978,312 | 4/1951 | France | 52/529 |
| 1,055,219 | 4/1959 | Germany | 52/520 |
| 43,519 | 1/1927 | Norway | 52/552 |
| 216,561 | 3/1967 | Sweden | 52/545 |
| 950,174 | 2/1964 | United Kingdom | 52/520 |

*Primary Examiner*—Leslie Braun
*Attorney, Agent, or Firm*—Martin E. Gerry

[57] ABSTRACT

A tile, generally used for roofing purposes, made of metal or synthetic material, has two portions, one portion has a convex upper surface and another portion has a concave upper surface. These portions are integral with each other and do not overlap one another. The underfaces of these portions exhibit cavities thereat. The length of one of the portions is greater than the length of the other portion. When laid upon a roof area the ends of the tiles will be made to overlap a predetermined length of the tile to give the appearance of a roof formed with conventional spanish mission tiles. Adjacent or contiguous tiles are interlocked by means of a curled corner of the other portion of the tile.

27 Claims, 5 Drawing Figures

MULTI PORTION TILE HAVING A CURLED INTERLOCK

RELATED PENDING APPLICATIONS

This application covers in substance most of the subject matter of Australian Provisional Application Ser. No. PC 0843/75 filed Mar. 10, 1975, for which priority is claimed pursuant 35 USC 119.

This application is also a continuation-in-part of copending U. S. application Ser. No. 626,332 filed Oct. 28, 1975, now abandoned by the same inventor.

BACKGROUND OF THE INVENTION

This invention is in the field of construction tiles and more particularly in the field of roofing tiles, sometimes of metal or of a synthetic material such as a plastic.

For many years roofing material has been commonly corrugated galvanized iron, or consisted of tiles made of fired clay. More recently, cement tiles have been utilized. These types of tiles however are extremely heavy and expensive to manufacture and ship. Certain of these tiles are in overlapping configuration as to their portions, particularly the cement tiles, making them difficult to mold and economically prohibitive to fabricate.

The prior art also does not provide construction tiles of metal that are self-interlocking without the use of external clips or fasteners.

SUMMARY OF THE INVENTION

It is therefore an object of this invention to provide a lightweight tile, which has the appearance of a conventional clay or concrete tile, made of various types of metals, resins or plastics, and to provide an interlock means as part of each tile for joining other similar tiles to each other.

Another object is to provide a simulated spanish mission tile but made of lightweight metal.

Still another object is to make such tiles inexpensive so that outer and inner walls or roof may be lined therewith to fireproof same.

Therefore, in accordance with this invention, a metal tile is provided made of a one piece or integrated construction comprising a first portion having a convex upper surface and a second portion adjacent to and integral with the first portion having a concave upper surface. The tile at the upper end having ends of these portions that are coterminous while the lower or opposite ends of such portions not being coterminous. The tile is open faced in cavity-like appearance in its understructure, and the two portions thereof are not in overlapping configuration. Such tiles may also be made of a synthetic resin or plastic which is not flammable as well as of sheet metal, copper or aluminum. If made of aluminum the tile can be anodized in different colors. If made of copper the tile is permitted to form an oxide coating of copper to render a roof of such tiles beautiful in appearance and expensive looking. Such tile is also provided with a curled corner of the second portion of interlocking similar tiles.

DETAILED DESCRIPTION

Figure 1:
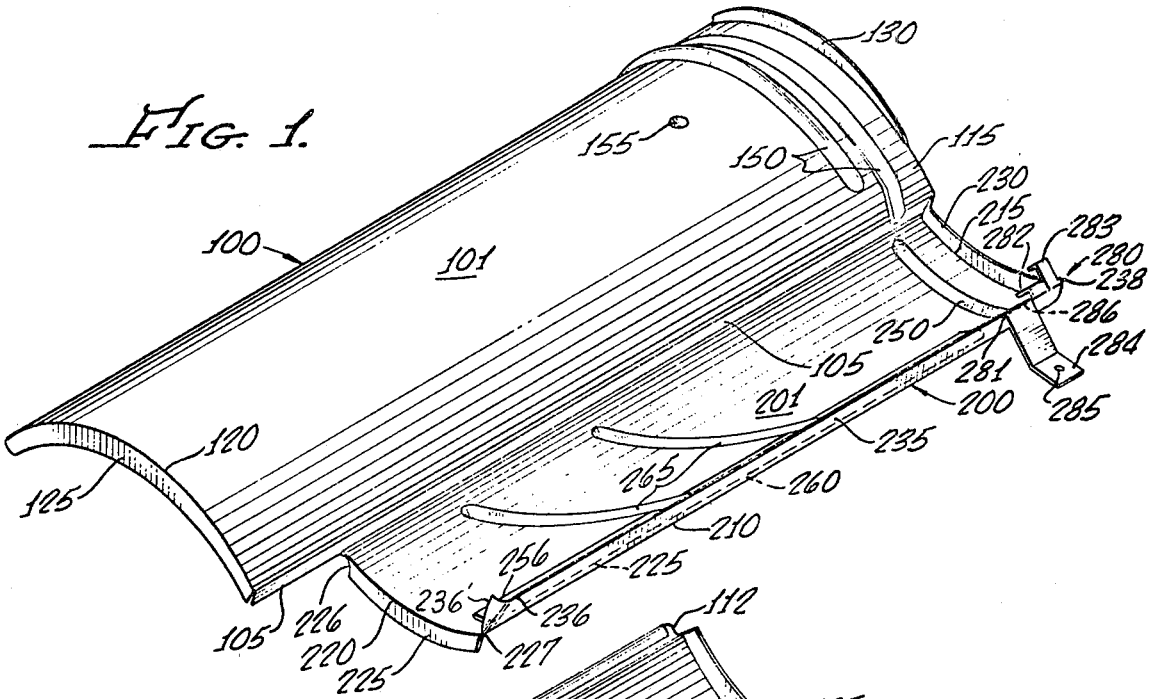
FIG. 1 shows in perspective the convex surface of a first portion of the tile and the concave surface of a second portion of the tile integral with the first portion and in non-overlapping configuration with each other. This figure illustrates a clip in perspective for securing the tile to a roof structure, which clip is an integral part of the second portion. Also shown is the interlock curled portion for joining other tiles to each other.

Referring to FIGS. 1, 2, 3 and 5, a tile according to the principles embodied in this invention comprises the combination of portion 100 integral with and non-overlapping portion 200.

Portion 100 has exposed to view, during use of the tile, its convex surface at 101. Likewise portion 200 has exposed to view, in such normal usage, its concave surface 201.

The undersurfaces of both portions 100 and 200 are generally not exposed to view when the tile is in actual usage, and these undersurfaces are open faced forming the appearance of cavities. Undersurface 102 of portion 100 is therefore concave with flanges and ribs integral therewith, whereas undersurface 202 of portion 200 is convex and likewise with flanges and ribs as integral portions thereof.

The structure of portions 100 and 200 may be readily described as to their general form in terms of arc-shaped sections of a cylinder C. Portion 100, without the consideration of flanges and ribs, could be obtained when an imaginary plane at P—P slices a section of cylinder C. Portion 200, also without consideration of flanges and ribs, could be obtained when an imaginary plane at Q—Q slices another section of cylinder C. Planes P—P and Q—Q would be parallel to each other and to central axis A of cylinder C, which central axis would be coaxial with the walls of cylinder C.

Portions 100 and 200 are disposed with respect to each other along directions parallel to axis A wherein convex surface 101 faces in the same direction as concave surface 201.

Portion 200 is in non-overlapping configuration with any part of portion 100 as illustrated by the fact that a step or flange at 105 is integral with portion 100 and joins an edge of portion 200.

Portions 100 and 200 have edges at 110 and 210 respectively, which edges are generally parallel to axis A.

Portion 100 has ends at 115 and 120, and portion 200 has corresponding ends at 215 and 220, which ends are generally orthogonal to the edges and to axis A.

Insofar as material that the tile is structured, it may be metallic such as sheet metal that is galvanized, aluminum which may be anodized, or may be made of fireproof or fire resistant synthetic resin or plastic. Surfaces 101 and 201 may be coated chemically or painted as at 197 and 297 respectively in desirable color and may have material such as sand, stone or bituminous particles as at 198 and 298 respectively bound within the coating material of varying and preselected sizes and colors. A reddish color may be used as the coating thereby simulating the appearance of a spanish type solid tile made of clay or adobe. If the tile is of anodized material such as aluminum a variety of different and interesting permanent colors may be obtained. This title may also be made of copper which when permitted to oxidize will develop a brilliant green copper oxide coating and render the structure upon which the tiles are installed very expensive looking and beautiful in appearance.

Portion 100 is generally longer than portion 200, one end of portion 100 being longer than a corresponding end of portion 200. Portion 100 has a flange at 125 extending radially inward away from surface 101 toward axis A. Portion 200 has a flange 225 at end 220 extending radially outward away from surface 201 and axis A. Hence the additional length of portion 100 forms a shoulder with portion 200 at ends 120 and 220, represented by flanges 125 and 225 respectively. Such shoulder facilitates assembly of a plurality of these tiles into a structure such as a roof.

Flange 130 integral with portion 100 is provided at end 115 extending radially outward from surface 101 away from axis A.

Flange 110 is terminated in a flange-hook configuration as at 135 inwardly toward surface 102 and toward axis A. It should be noted that flange 110 does not extend the entire length of portion 100 but terminates prior to reaching end 120.

Flange 225 at end 220 extends radially outward away from surface 202 and axis A and does not extend to the edges of portion 200, thus leaving scalloped cut-outs thereat at 226 and 227 that limits the width of flange 225 and inhibits flange 225 from cooperating with flanges 105 and 235.

Flange 230 is integral with and is provided at end 215, which flange extends radially inward toward axis A.

Flange 235 is integral with portion 200 and is provided at edge 210. This flange is oriented generally at an obtuse angle with respect to surface 201 at edge 210. Flange 235 is tapered so that its highest point at 236 close to end 220 is higher than its lowest point at 237 near edge 215 for ease of sliding this flange beneath fingers of a clip to be hereinbelow discussed. Flange 235 makes a slight ear-like depression 238 in cooperation with flange 230 at the junction of edge 210 and end 215.

Figure 4:
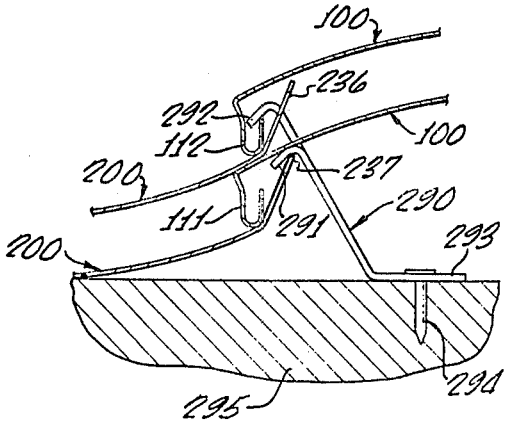
FIG. 4 shows partly in cross-section and partly in elevation the use of an independent clip holding ends of several tiles when such tiles are assembled in a roof structure.
Figure 5:
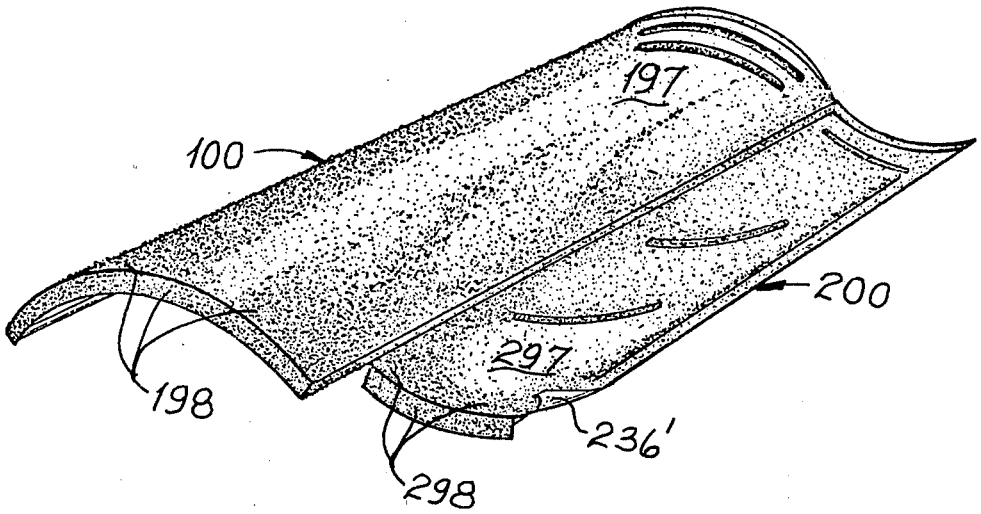
FIG. 5 is a perspective view similar to FIG. 1 showing details of particulate matter embedded in a binding coating on the outer tile surfaces.

Ear-like depression 238 is the location at which first finger 281 of a tile fastening clip 280 is formed as an integral part of portion 200. Finger 281 is scored at 286 so that this finger and thusly the clip may be broken off thereat when not in use. Clip 280 has finger 282 provided for holding down the high point at 236 of flange 235 of a like tile installed on surface 201 above the instant tile, as well as flange-hook 135 of flange 110 at 112. Finger 283 is provided for holding down still another tile placed on surface 201 adjacent to the instant tile. Clip portion 284 is provided with a hole at 285 for securing this and other tiles held by the clip to a generally wooden surface beneath the tiles forming part of the roof structure as illustrated in FIG. 4 below.

End 115 of portion 100 is generally coterminous with end 215 of portion 200, which ends may be represented by flanges 130 and 230 respectively.

At least one rib as at 150 is provided as an integral part of portion 100, which rib is generally parallel to ends 115 and 120 for strengthening portion 100 particularly when made of metal of about 0.050 inches thick or less. Sheet metal lends itself to easy and economical fabrication by die stamping same into the shape desired.

At least one rib as at 250 is provided as an integral part of portion 200, which rib is generally parallel to ends 215 and 220, though more like ribs may be utilized for strengthening portion 200.

At least one rib as at 255 is provided as an integral part of portion 200, which rib is generally parallel to edge 210, though more like ribs may be provided if needed for strengthening portion 200. Rib 255 extends along most of edge 210 adjacent to flange 235. Rib 255 is raised progressively from surface 201 at 256 to a raised location at 257. Raised location 257 and flange 235 form a recess at 260 into which an adjacent hook portion of a like tile, such as hook portion 135, can be seated.

At least one rib as at 265 integral with portion 200 may be oriented at an angle with respect to ends 215 or 220 providing reinforcement of portion 220.

Portion 100 is provided with a depression as at 155 for providing securing capability of the tile by driving a nail therethrough into a wood member of a roof structure running the length of portion 100 and the roof. Such nail would be hidden when another like tile is placed on top of a part of portion 100 wherein end 120 of such other tile covers the nail and also covers a part of the instant tile.

With reference also to FIG. 4, clip 290 may be provided as an alternate to clip 280, which clip 290 is not attached to portion 200 permanently. Clip 290 only requires two fingers, namely fingers 291 and 292. Finger 291 holds down flange 235 at 237 and also hook member 135 of an adjacent tile at 111. Finger 292 holds down flange 235 at 236 of another like tile mounted vertically and overlapping the instant tile and also holds down hook 135 at 112 of such another like overlapping tile. A hole is provided in part of clip 293 into which nail 294 is generally used to be driven into undersurface of wood at 295 of a typical roof structure.

It should be noted that not only do the various flanges act as strengthening means, but they also act as weather checks to inhibit rain or water flow or moisture from the underside of a matrix of similar tiles affixed to a roof or other part of a structure. Additionally, it should be noted that the various ribs also strengthen the tiles, even when such tiles are made of thin material.

Of special significance is the formation by inexpensive fabrication a two-portion tile which two portions do not overlap wherein the underface of the tile exhibits a cavity in each of the two portions to enable the achievement of the invention objectives of a light weight inexpensive tile than simulates the expensive spanish roof tile or expensive and beautiful roofing structure made from such tiles particularly when the material used is copper.

Figure 2:
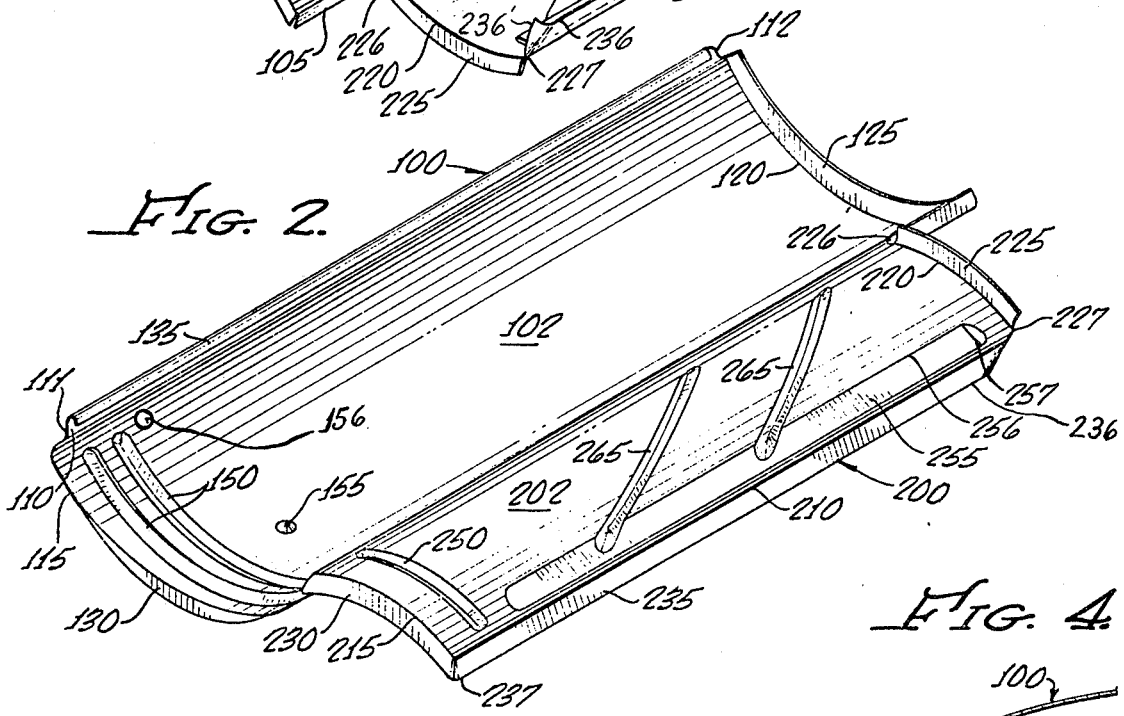
FIG. 2 shows the same tile in perspective view as in FIG. 1 except that such tile is flipped about so as to view the underside thereof, thereby showing the concave surface of the first portion and the convex surface of the second portion in cavity-like structure. The clip shown in FIG. 1 is omitted from this figure.
Figure 3:
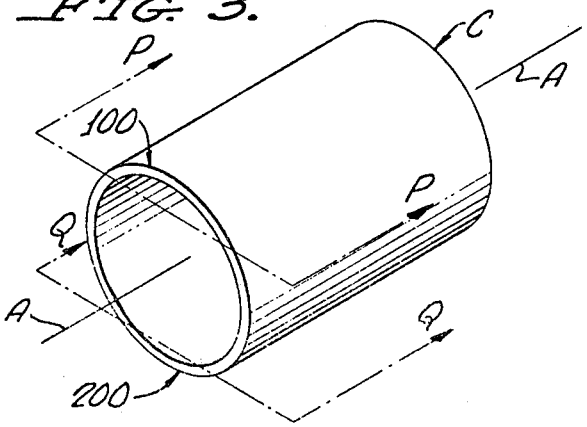
FIG. 3 shows a cylinder in perspective view cut by imaginary planes lengthwise parallel to its central axis so as to result in arc-shaped structures describing the general shapes of the portions of the tile.

With special reference to FIGS. 1, 2 and 3, it may be seen that curl member 236' at 236 formed from a portion of flange 235 is an integral part of portion 200.

Curl 236' is formed at a slight angle, between 10° and 30° approximately with respect to surface 201 and away from axis A. This curled member enables adjacent tiles and tiles below the tile illustrated to be held by the curl member thereby substituting for the integral clip 280 and the separate clip 290 as discussed above, making such clips unnecessary.

An advantage to be gained by using the curled member is not only to eliminate the clips but reduce labor in nailing down such clips. The only hardware needed would be a nail such as 294 to hold down the tile at a point diagonally opposite curl 236' by using hole at 156 to fasten the tile to the wooden under structure as at 295.

I claim:

1. A tile having arc-shaped portions, each of the portions being generally describable by an imaginary cylinder sliced by an imaginary plane parallel to a central axis coaxial with the walls of the cylinder, comprising in combination:

a first of said portions having convex and concave oppositely disposed surfaces;

a second of said portions, integral with the first of said portions, having concave and convex oppositely disposed surfaces, the convex surface of the first portion and the concave surface of the second portion forming an outer surface of the tile, said second portion having a curled portion only at the approximate intersection of a first imaginary line describing one edge of the second portion to said axis with a second imaginary line perpendicular to said first imaginary line;

particulate matter disposed over said outer surface; and a coating material binding said particulate matter to said outer surface.

2. The invention as stated in claim 1, wherein said tile is metallic.

3. The invention as stated in claim 1, wherein said tile is of a plastic material.

4. The invention as stated in claim 1, including means adapted to the second portion for securing said tile.

5. The invention as stated in claim 1, wherein said second portion is in non-overlapping configuration with any part of the first portion.

6. The invention as stated in claim 1, wherein said first portion has a depression therein for providing securing capability of said tile.

7. The invention as stated in claim 1, including means integral with the second portion for securing said tile.

8. The invention as stated in claim 7, wherein said means is scored for severing same from said second portion.

9. The invention as stated in claim 7, wherein said means also secures a like said tile.

10. The invention as stated in claim 7, wherein said means is a multifingered clip.

11. The invention as stated in claim 1, wherein the first and second portions have edges generally parallel to said axis and ends generally orthogonal to said axis, and where the surfaces opposite to said outer surface each comprises a cavity thereat.

12. The invention as stated in claim 11, wherein one of the ends of the first portion is longer than one of the ends of the second portion.

13. The invention as stated in claim 11, including a first flange at one end of the first portion extending radially outward away from said axis.

14. The invention as stated in claim 13, including a second flange at the other end of the first portion extending radially inward in a direction opposite to the direction of the first flange.

15. The invention as stated in claim 14, including a third flange at one edge of the first portion, said one edge not being joined to said second portion, said third flange terminating in a flange-hook configuration directed inwardly toward said axis.

16. The invention as stated in claim 15, wherein the flange-hook extends a part of the length of said one edge.

17. The invention as stated in claim 11, including a first flange at one end of the second portion extending radially inward toward said axis.

18. The invention as stated in claim 17, including a second flange at the other end of the second portion extending radially outward away from said axis.

19. The invention as stated in claim 18, including a third flange at one edge of the second portion, said one edge not being joined to said first portion, said third flange forming an obtuse angle with the concave surface of the second portion.

20. The invention as stated in claim 18, wherein said second flange does not extend to the edges of said second portion.

21. The invention as stated in claim 11, including a flange parallel to said axis joining the first and second portions.

22. The invention as stated in claim 11, wherein a first end of the first portion is generally coterminous with a first end of the second portion.

23. The invention as stated in claim 22, wherein a second end of the first portion, opposite to the first end thereof, forms a shoulder with a second end of the second portion which is opposite the first end thereof.

24. The invention as stated in claim 11, including at least one rib, integral with the first portion, generally parallel to one of the ends thereof.

25. The invention as stated in claim 11, including at least one rib integral with the second portion generally parallel to one of the ends.

26. The invention as stated in claim 11, including at least one rib integral with the second portion generally parallel to one edge thereof.

27. The invention as stated in claim 11, including at least one rib integral with the second portion and oriented at an angle with respect to said ends.

* * * * *